US009251636B2

(12) United States Patent
Ito

(10) Patent No.: US 9,251,636 B2
(45) Date of Patent: Feb. 2, 2016

(54) DOCUMENT VALIDATING/STACKING DEVICE

(71) Applicant: JAPAN CASH MACHINE CO., LTD., Osaka (JP)

(72) Inventor: Kenichi Ito, Tokyo (JP)

(73) Assignee: JAPAN CASH MACHINE CO., LTD., Osaka (JP)

( * ) Notice: Subject to any disclaimer, the term of this patent is extended or adjusted under 35 U.S.C. 154(b) by 0 days.

(21) Appl. No.: 14/607,574

(22) Filed: Jan. 28, 2015

(65) Prior Publication Data

US 2015/0213668 A1 Jul. 30, 2015

(30) Foreign Application Priority Data

Jan. 29, 2014 (WO) ..... PCT/JP2014/000463

(51) Int. Cl.
*G07F 7/04* (2006.01)
*G07D 11/00* (2006.01)

(52) U.S. Cl.
CPC ..... *G07F 7/04* (2013.01); *G07D 11/0012* (2013.01); *B65H 2402/344* (2013.01); *B65H 2405/1142* (2013.01); *G07D 11/0006* (2013.01)

(58) Field of Classification Search
CPC ..... B65H 2301/421; B65H 2402/44; B65H 2402/344; B65H 2403/41; B65H 2405/1142; B65H 2405/11425; B65H 2701/1912; G07D 11/0006; G07D 11/0012; G07F 7/04
USPC ..... 194/206, 207, 350; 271/84, 177, 207
See application file for complete search history.

(56) References Cited

U.S. PATENT DOCUMENTS

| | | | | |
|---|---|---|---|---|
| 5,653,436 | A | 8/1997 | Zouzoulas | |
| 5,657,846 | A | 8/1997 | Schwartz | |
| 5,676,366 | A | 10/1997 | Polidoro | |
| 6,241,240 | B1 | 6/2001 | Bukhman | |
| 6,948,607 | B2 * | 9/2005 | Ito et al. | 194/206 |
| 7,481,308 | B2 * | 1/2009 | Bergeron et al. | 194/350 |
| 8,167,301 | B2 | 5/2012 | Nireki | |

FOREIGN PATENT DOCUMENTS

| | | | |
|---|---|---|---|
| JP | 60-92367 | U | 6/1985 |
| JP | 8-27856 | B2 | 3/1996 |
| JP | 8-507743 | A | 8/1996 |
| JP | 2001-283284 | A | 10/2001 |
| JP | 2002-512931 | A | 5/2002 |
| JP | 2009-217540 | A | 9/2009 |

* cited by examiner

*Primary Examiner* — Mark Beauchaine
(74) *Attorney, Agent, or Firm* — Bachman & LaPointe, P.C.

(57) ABSTRACT

A document validating/stacking device is provided that has a validator 1 provided with a swingable rocker 10 formed with a head 16 and a stacker 2 detachably attached to validator 1. Stacker 2 comprises an X-linkage 20 having a driver arm 41 that is separably pushed by head 16 in the same rotational direction as head 16 swings to expand X-linkage 20, to thereby move pusher plate 18 from the initial position to the extended position and to stow the document within interim chamber 24 into storage 7.

13 Claims, 16 Drawing Sheets

DOCUMENT VALIDATING/STACKING DEVICE

TECHNICAL FIELD

This invention relates to a document validating/stacking device that has a rocker provided in a validator to have the rocker rotating and to thereby extend an X-linkage in a stacker that smoothly stows a document in an interim chamber into a storage within the stacker.

BACKGROUND OF THE INVENTION

U.S. Pat. No. 5,653,436 discloses a secure currency cassette that comprises a mounting chassis, a transport unit attached to the mounting chassis and a currency cassette removably attached to the mounting chassis for storing currencies sent from the transport unit. The secure currency cassette further comprises an actuating fork rotatably mounted about a pivot within the transport unit, a cam whose outer surface drives one end of the actuating fork, and a pusher plate pushed by the other end of the actuating fork. Rotation of the cam causes the actuating fork to rotate so that the other end of the actuating fork pushes and moves the pusher plate to stow a currency inside the pusher plate into a predetermined position in the cassette.

U.S. Pat. No. 5,657,846 indicates a currency validator that comprises a processing unit and a security box releasably attached to the processing unit. This reference has no detailed explanation on the security box depicted in the drawings, however, it apparently comprises an interim chamber for temporarily retaining currencies received from the processing unit, a storage for storing currencies therein and an X-linkage for stowing each of the currencies in the interim chamber into the storage. The currency validator has a rotatable cam to cause the X-linkage to extend during rotation of the cam to squeeze the currency in the interim chamber into the storage.

Japanese Patent Publication No. 8-27856 represents a bill validator that comprises, just like the above second reference, a cam and an X-linkage extended by rotation of the cam to stow a bill in an interim chamber into a storage.

The security currency cassette in the first reference is disadvantageous that it must rely on the large-sized and heavy actuating fork operated by rotation of the cam to push the currency into a predetermined position of the cassette. Both of validators shown in the second and third references employ an X-linkage that can desirably provide a large pressing stroke for a push plate to stow a bill into a cassette. Both of cams in the second and third references have the specific outer configuration in slide contact to the X-linkage during rotation of each cam to turn rotational movement of the cam into extended and retracted linear movement of the X-linkage but with some involved mechanical imperfections.

First, the cam may necessarily involve undesirable friction, slippage, wear and abnormal noise in a sliding boundary with a follower driven by the cam to turn rotational motion of the cam into a different motion of the follower. In addition, the cam that drives a follower such an X-linkage, is alleged to require a lesser pressure angle formed between a pushing direction of the cam and a moving direction of the X-linkage because a greater pressure angle would disadvantageously exert a larger gouging force on contiguous X-linkage. In this view, allegedly ordinary skill in the art must restrict the permissible pressure angle of the cam less than maximum 45 degrees relative to the follower. Accordingly, to reduce the pressure angle of the cam for good collaboration with a prior art X-linkage, the cam device disadvantageously requires utilization of a larger sized cam. Moreover, for different travel strokes of X-linkage, modification should be made to an outer configuration of the cam.

An object of the present invention is to provide a document validating/stacking device that has a rocker provided in a validator to have the rocker rotating and separately pushing an X-linkage in a stacker that smoothly extends and stows a document in an interim chamber into a storage within the stacker.

SUMMARY OF THE INVENTION

The document validating/stacking device according to the present invention, comprises: a validator (1) for discriminating authenticity of an inserted document and a stacker (2) detachably attached to validator (1) for storing the document supplied from validator (1). Validator (1) comprises a rocker (10) rotatably attached around a pivot shaft (30), a head (16) formed with rocker (10) and a drive device (11) for rotating rocker (10) around pivot shaft (30). Stacker (2) comprises an interim chamber (24) for receiving and retaining the document sent from validator (1), a storage (7) for storing documents supplied from interim chamber (24), a pusher plate (18) movable between an initial position within interim chamber (24) and an extended position within storage (7), and an X-linkage (20) having a driver arm (41). Rotation of rocker (10) causes head (16) to move in a circular arc to separably push a passive area (45) of driver arm (41) that therefore rotates in the same rotational direction as the circular arc movement of head (16) to expand X-linkage (20), to thereby move pusher plate (18) from the initial position to the extended position and to stow the document within interim chamber (24) into storage (7).

Drive device (11) may cause head (16) to move in the circular arc through rotation of rocker (10), and this leads to a larger circular arc movement of head (16) than a radial displacement by a prior art cam device to more increase the extension length of X-linkage (20). It also is naturally easier and more efficient to convert the circular arc movement of head (16) into the rotational movement of driver arm (41) in X-linkage (20). In addition, head (16) may push passive area (45) of driver arm (41) in the same rotational direction as the circular arc movement of head (16) with the substantially zero pressure angle and with less slippage between head (16) and driver arm (41). This may cause reduced slipping loss without substantial wear and abnormal noise between head (16) and driver arm (41).

BEST MODE FOR CARRYING OUT THE INVENTION

With reference to FIGS. 1 to 19 of the drawings, embodiments are hereinafter described of the document validating/stacking device according to the present invention applied to a bill validating/stacking device. The term "a document" or its plural form herein means all and any valuable paper or valuable card or their plural form that contains bills, currencies, securities, tickets, credit cards while the description specifies bills for documents in the undermentioned embodiments.

Figure 1:
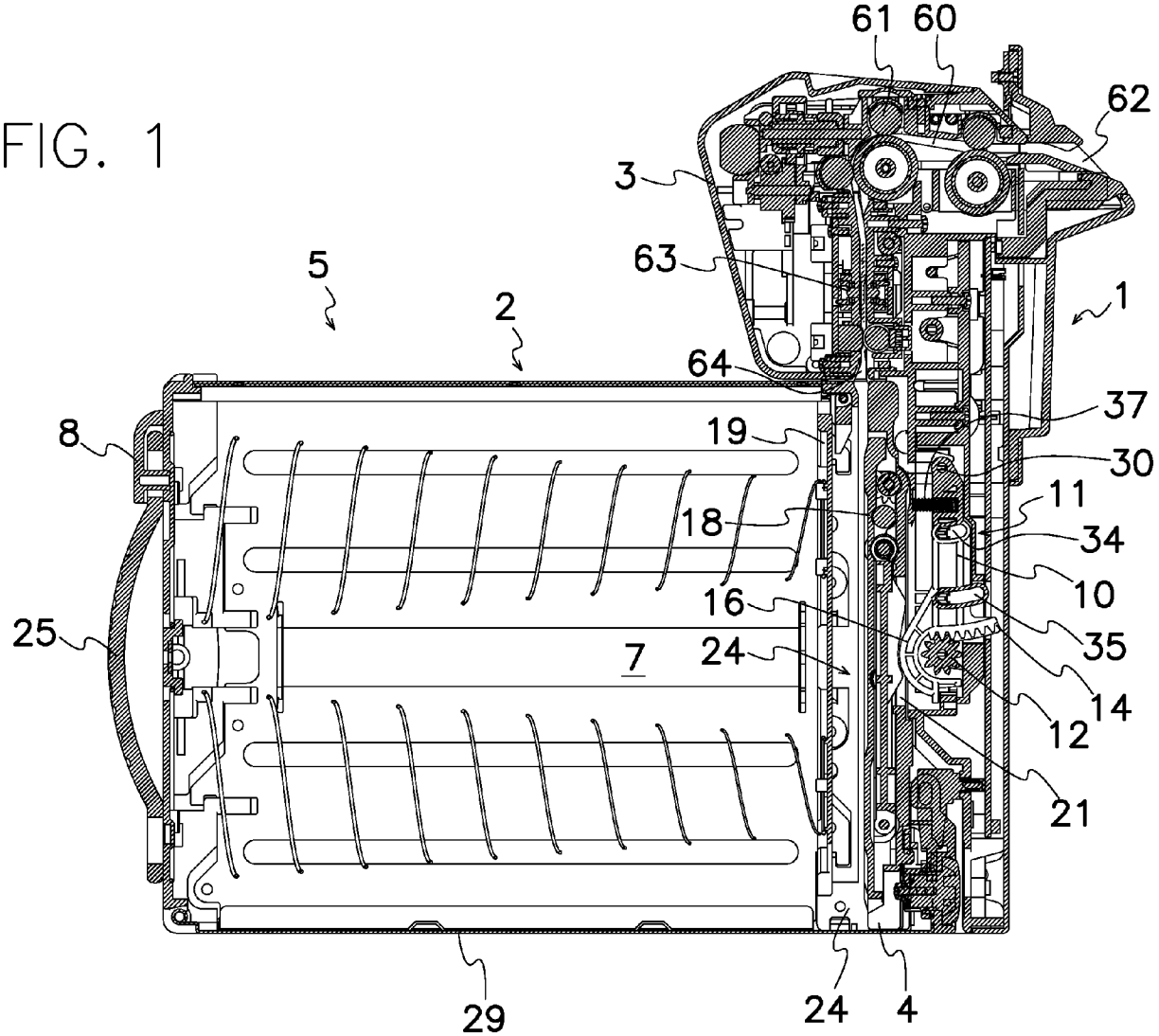
FIG. 1 is a sectional view of the document validating/stacking device according to the present invention made up of a validator and a stacker attached to the validator.
Figure 2:
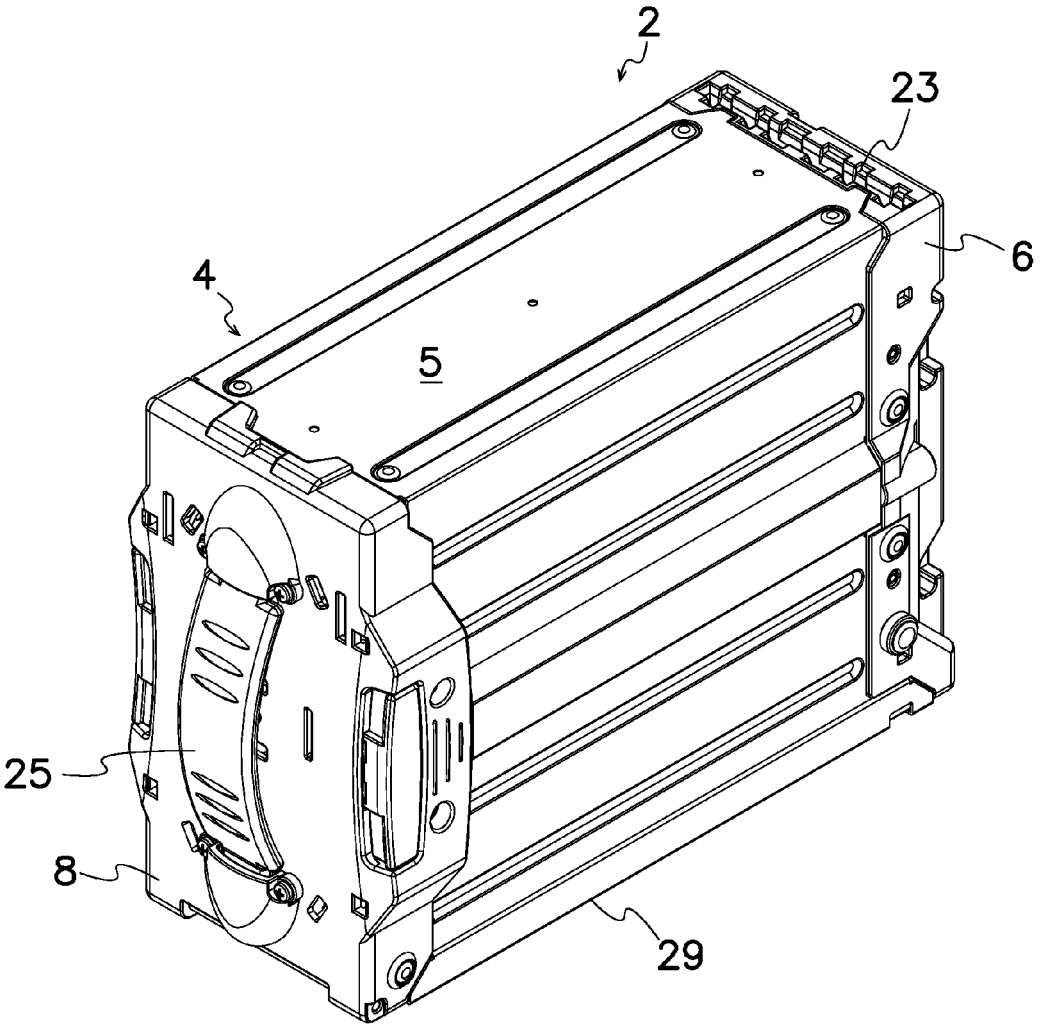
FIG. 2 is a perspective view showing an overall appearance of the stacker.

As shown in FIGS. 1 and 2, the bill validating/stacking device of the invention comprises a validator 1 for discriminating authenticity of bills inserted into validator 1 and a stacker 2 detachably attached to validator 1 for storing documents supplied from validator 1. As seen from FIG. 1, validator 1 comprises a passageway 60, a conveyor device 61 arranged adjacent to passageway 60 to transport bills along passageway 60, an inlet 62 formed at one end of passageway 60 to insert bills into passageway 60 through inlet 62, a validation sensor 63 for detecting optical or/and magnetic features of bills passing through passageway 60, and an outlet 64 to discharge bills from passageway 60 into stacker 2.

During operation of conveyor device 61, a bill inserted from inlet 62 is transported along passageway 60 while validation sensor 63 detects optical and/or magnetic monetary features of the bill on the way through passageway 60 to produce a detection signal of monetary features. Validation sensor 63 is connected to a validation controller not shown that receives the detection signal from validation sensor 63 to make authenticity examination of the bill. When validation controller considers the bill authentic, it drives conveyor device 61 to send it along passageway 60 into stacker 2 through outlet 64.

Validator 1 comprises a rocker or swing lever 10 pivotally or rotatably attached around a pivot shaft 30 and a drive device 11 for rotating or swinging rocker 10. In a first embodiment of the invention shown in FIGS. 1 and 15, rocker 10 comprises an arm 31 rotatably mounted on pivot shaft 30, and an external sector gear 14 integrally formed in arm 31 and meshed with a pinion 12 of drive device 11. An arcuate extension 17 is also integrally formed with and protruded from arm 31 with a head 16 integrally formed on arcuate extension 17. In the shown embodiment, sector gear 14 is formed along the periphery of arm 31 for engagement with circumscribed pinion 12. Shown external sector gear 14 may be replaced with an internal sector gear formed on an inner surface of arcuate extension 17 integrated with head 16 to bring the internal sector gear into engagement with inscribed pinion.

Figure 16:
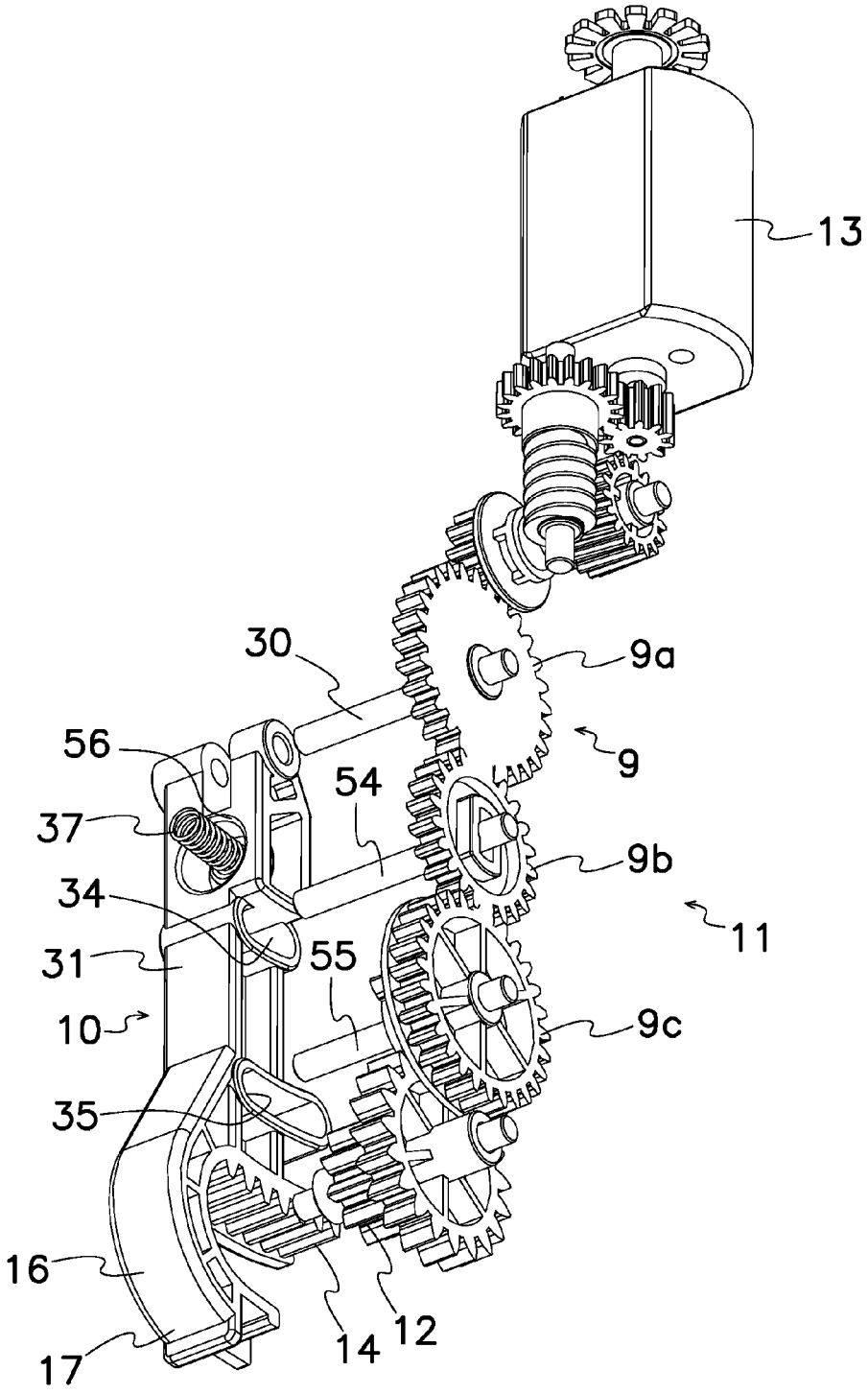
FIG. 16 is a perspective view of a drive device for rotating the rocker.

As seen from FIG. 16, drive device 11 comprises a drive motor 13 and a deceleration device 9 arranged in substantially parallel to rocker 10 and having an output shaft that supports pinion 12. Deceleration device 9 has a series of gears 9*a*, 9*b* and 9*c* drivingly interlocked in turn with first gear 9*a* rotatably mounted on pivot shaft 30 for rocker 10 to rotate pinion 12 by drive motor 13 through gears 9*a*, 9*b* and 9*c*. Second and third gears 9*b* and 9*c* of deceleration device 9 are rotatably mounted on support shafts 54 and 55 that pass through respectively arcuate holes 34 and 35 formed in arm 31 of rocker 10.

When drive motor 13 is operated, deceleration device 9 transmits rotation to pinion 12 to cause rocker 10 to oscillate or swing around pivot shaft 30 within its angular range confined by support shafts 54 and 55 arranged in arcuate holes 34 and 35 to prevent overrun in rotation of rocker 10 due to undesirable inertia force of drive device 11 upon stop of drive motor 13. Support shafts 54 and 55 also serve to effectively prevent deformation and transformation of rocker 10 in the undesirable direction. FIG. 16 illustrates an example of two arcuate holes 34 and 35 formed in arm 31 of rocker 10 to receive respectively support shafts 54 and 55, however, the invention also contemplates a single one or none of arcuate hole 34 and 35 in rocker 10. Otherwise, second and third gears 9*b* and 9*c* of deceleration device 9 may be rotatably mounted on support shafts integrally with or separately attached to arm 31.

Figure 15:
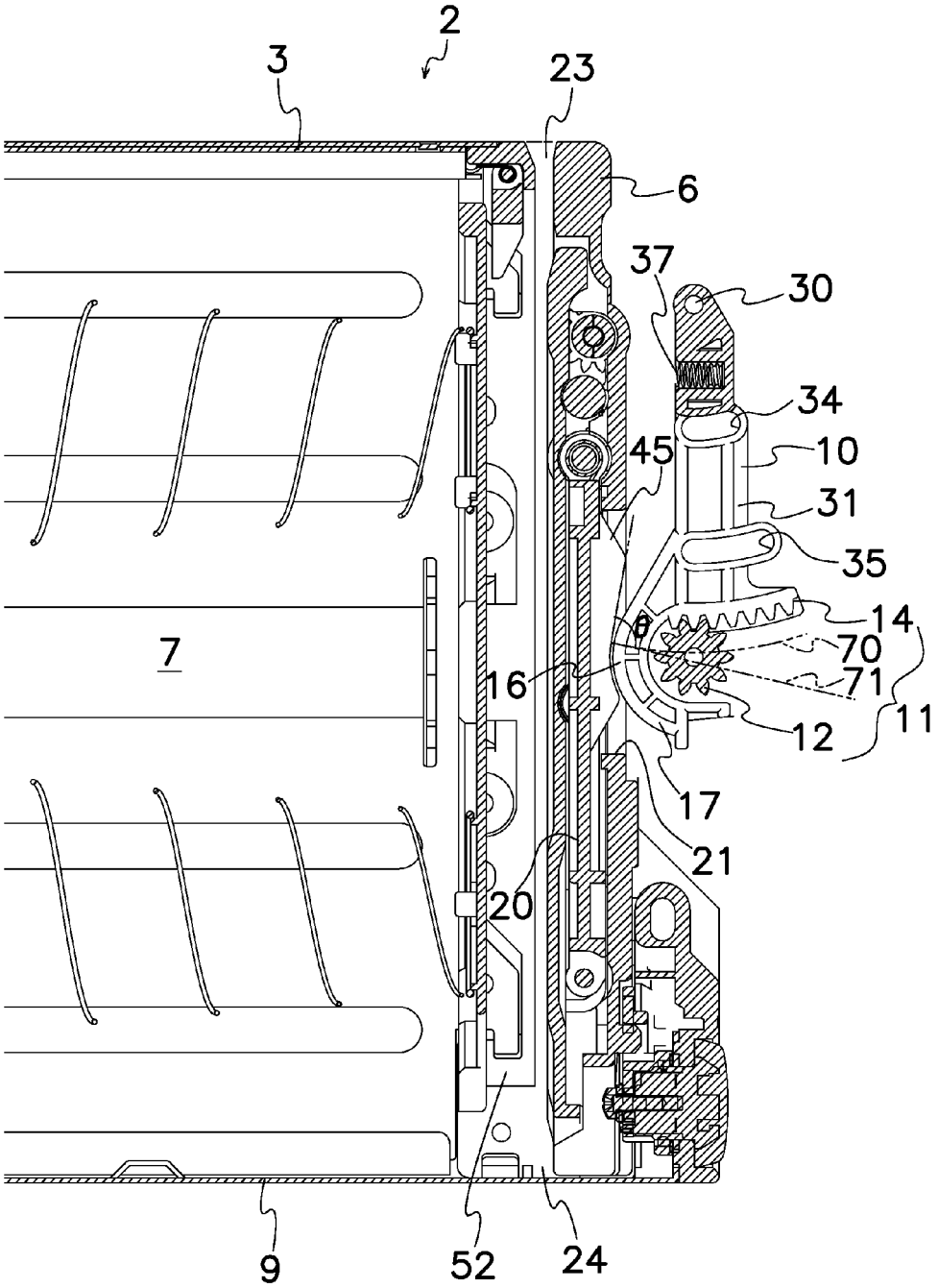
FIG. 15 is a partial sectional view depicting the X-linkage in the inner endplate and a rocker in the validator.

A spring 37 is arranged within a bore 56 formed in arm 31 of rocker 10 to prevent spring 37 from falling out of bore 56 by a frame 3 of validator 1 while spring 37 constantly resiliently urges rocker 10 toward its rest position shown in FIGS. 1 and 15.

Figure 3:
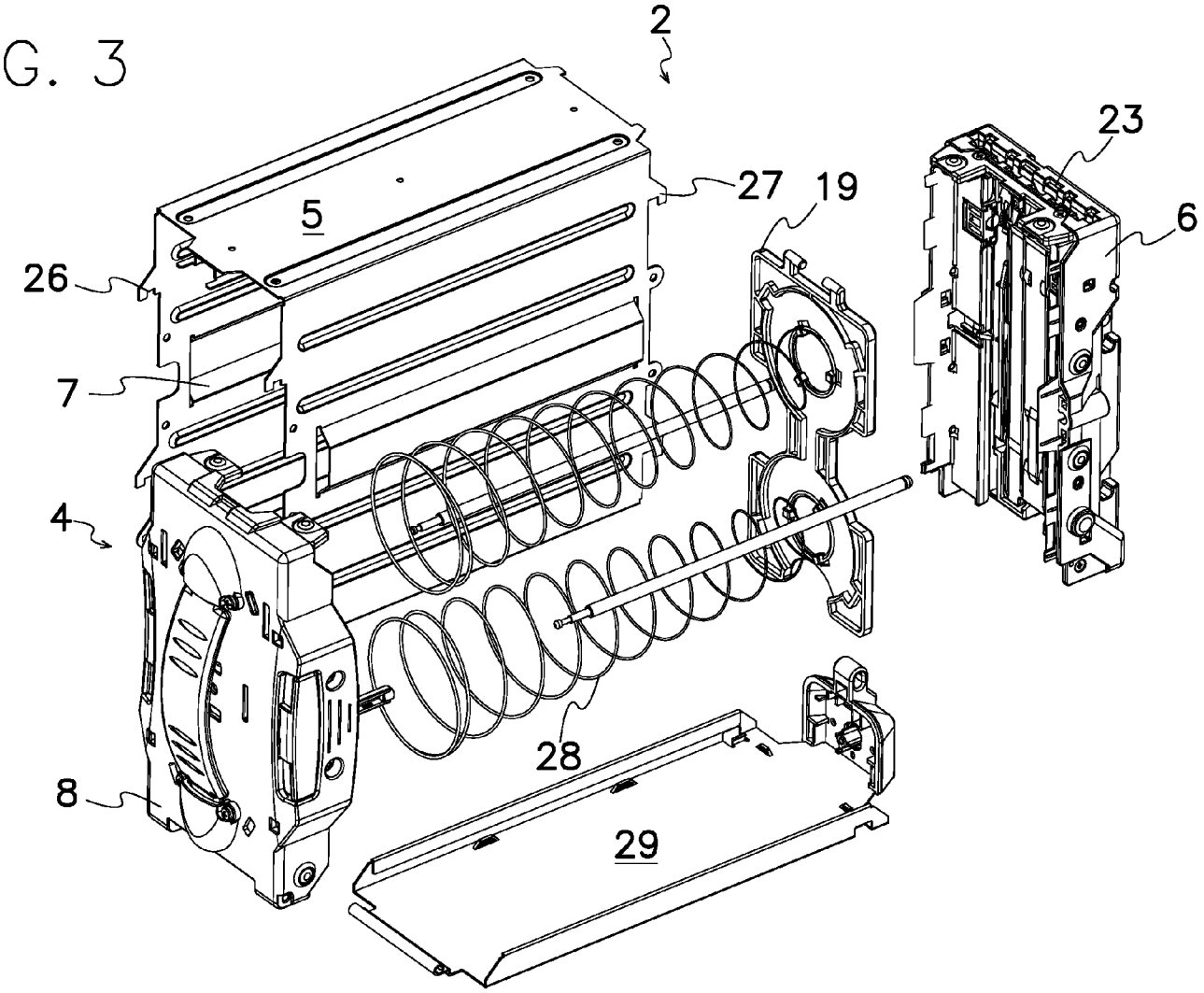
FIG. 3 is an exploded view of the stacker.
Figure 4:
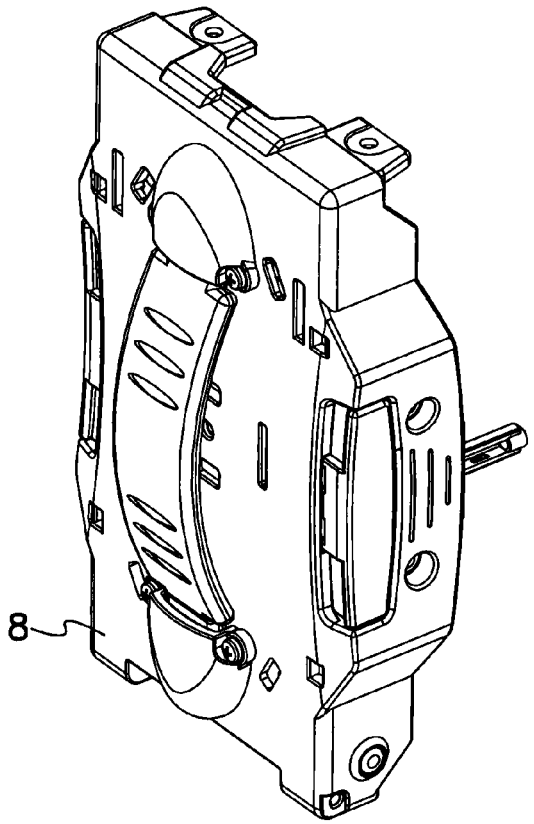
FIG. 4 is a perspective view of an outer endplate attached to an outer end of a sleeve in the stacker.

As seen in FIGS. 2 and 3, stacker 2 has a casing 4 that comprises a metallic sleeve 5 of a generally inverted U-shaped section, an outer endplate 8 attached to an outer end of metallic sleeve 5 and an inner endplate 6 attached to an inner end of metallic sleeve 5 to form a storage 7 in cooperation with metallic sleeve 5, outer and inner endplates 8 and 6 together. Stacker 2 has an openable cover 29 for closing a bottom area of storage 7; an outer end of cover 29 is rotatably attached to outer endplate 8 (FIG. 1); and an inner end of cover 29 is removably attached to inner endplate 6 (FIG. 15). When stacker 2 is detachably attached to validator 1 as shown in FIG. 1, inner endplate 6 of casing 2 is arranged across from validator 1 while outer endplate 8 of casing 2 is arranged on the opposite side of validator 2.

Figure 5:
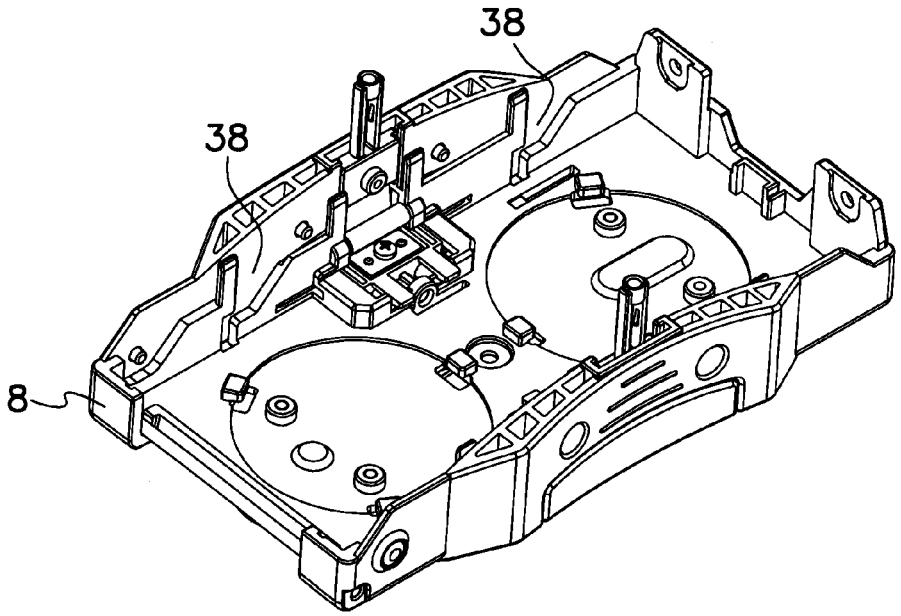
FIG. 5 is a perspective view showing inside of the outer endplate shown in FIG. 4.
Figure 6:
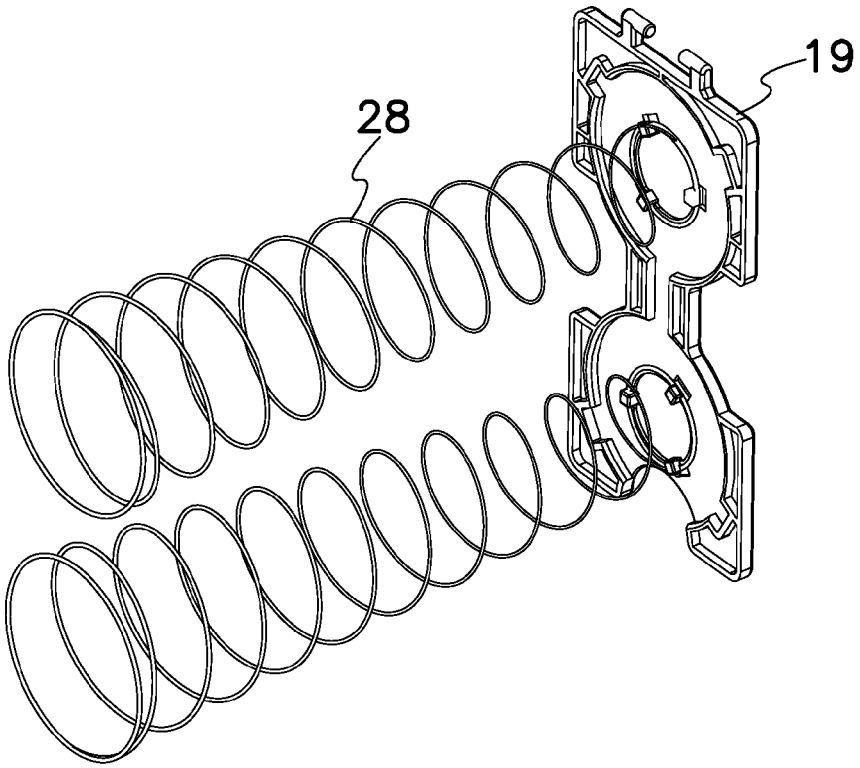
FIG. 6 is a perspective view showing coiled springs and a pusher plate attached to each end of the coiled springs.
Figure 9:
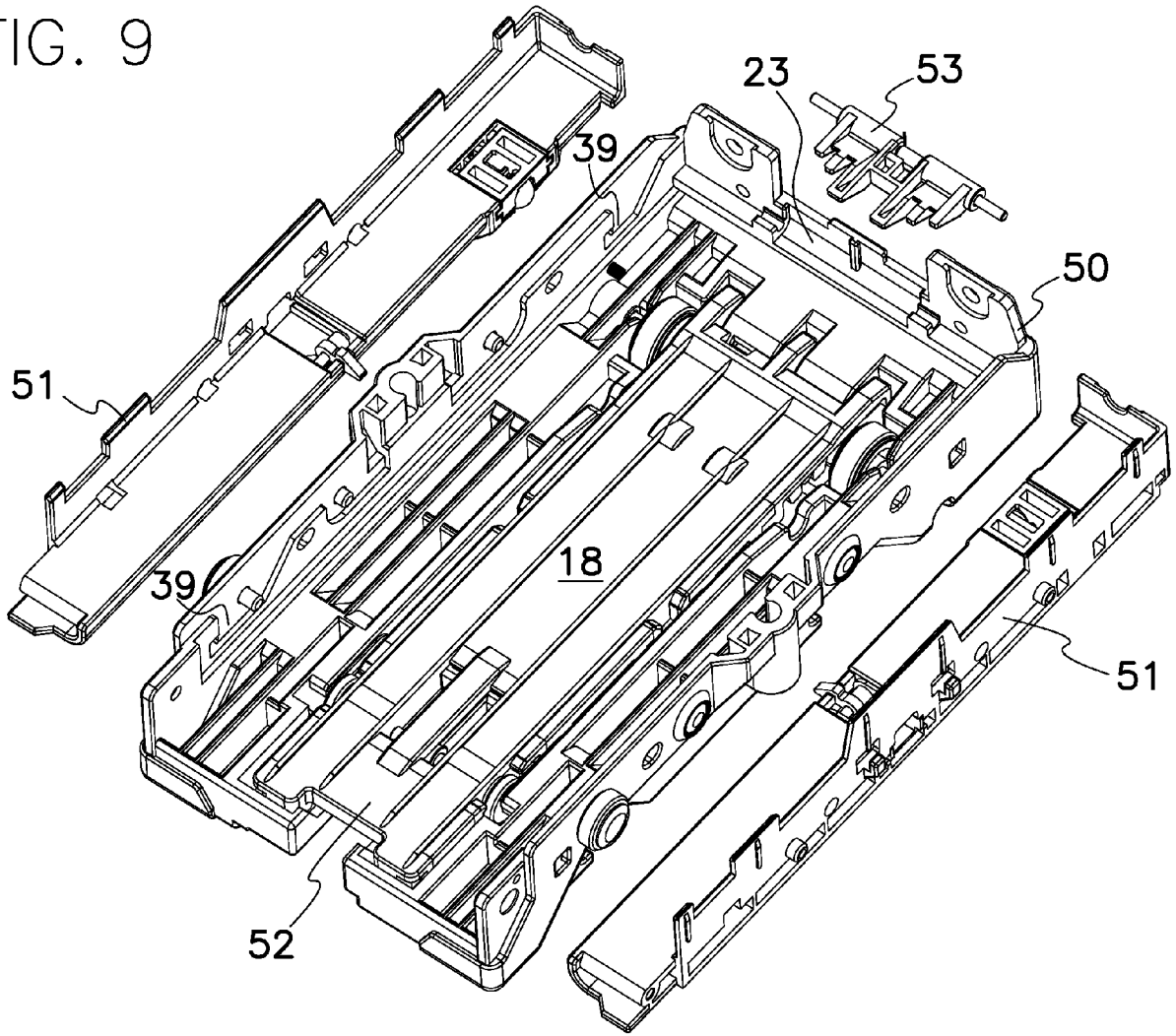
FIG. 9 is an exploded view of the inner endplate.
Figure 10:
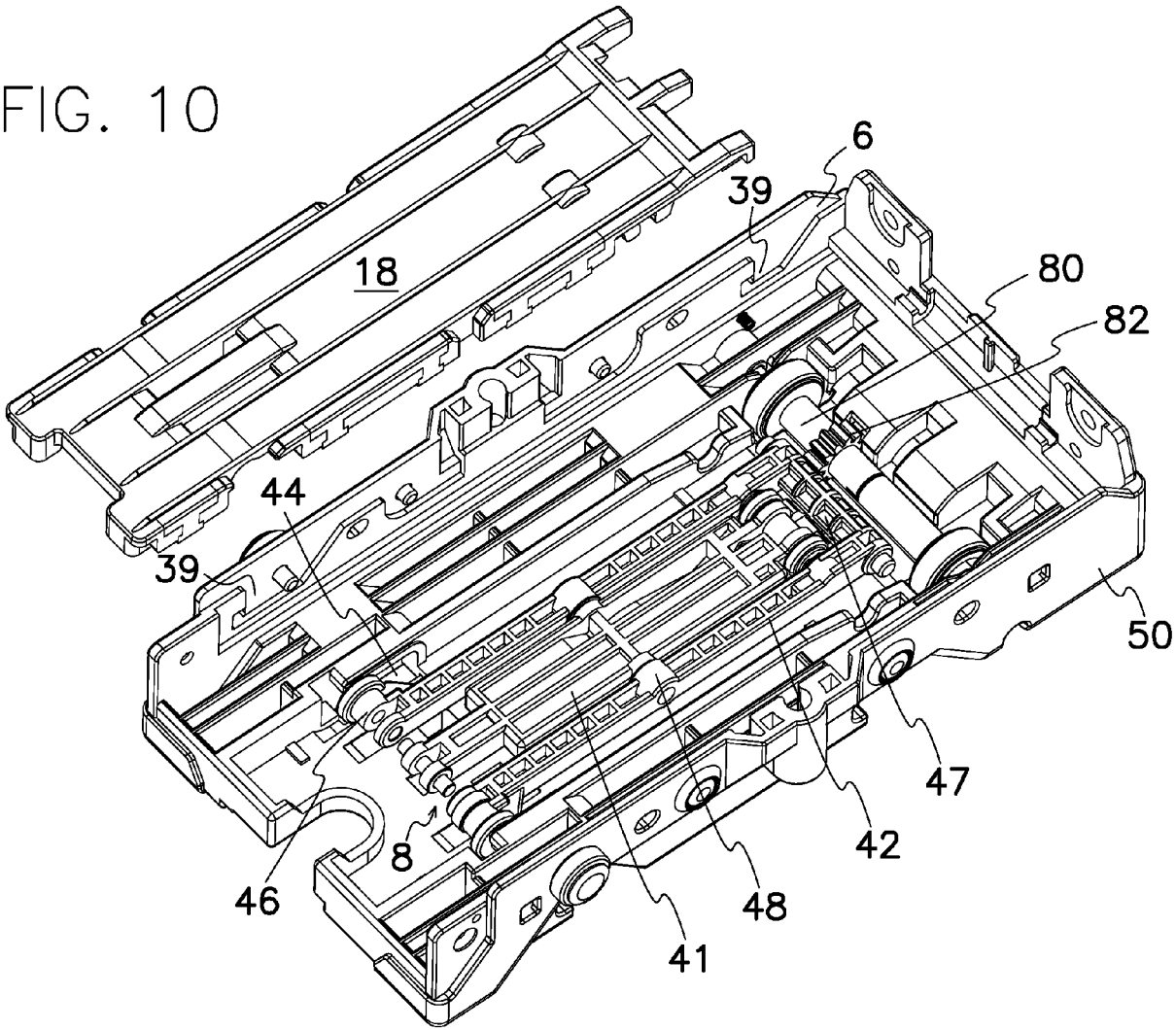
FIG. 10 is an exploded view of the inner endplate with removal of guide plates and a pusher plate in FIG. 9.

FIG. 3 depicts a plurality of outer hooks 26 and a plurality of inner hooks 27 respectively formed with outer and inner ends of sleeve 5 of casing 4 to fit outer and inner hooks 26 and 27 respectively in grooves 38 and 39 shown in FIGS. 5 and 9 in order to hold outer and inner endplates 8 and 6 on sleeve 5. As apparent from FIGS. 3 and 6, a pair of coiled springs 28 and a backup plate 19 are arranged inside outer endplate 8 to resiliently urge backup plate 19 toward inner endplate 6 by coiled springs 28.

Figure 7:
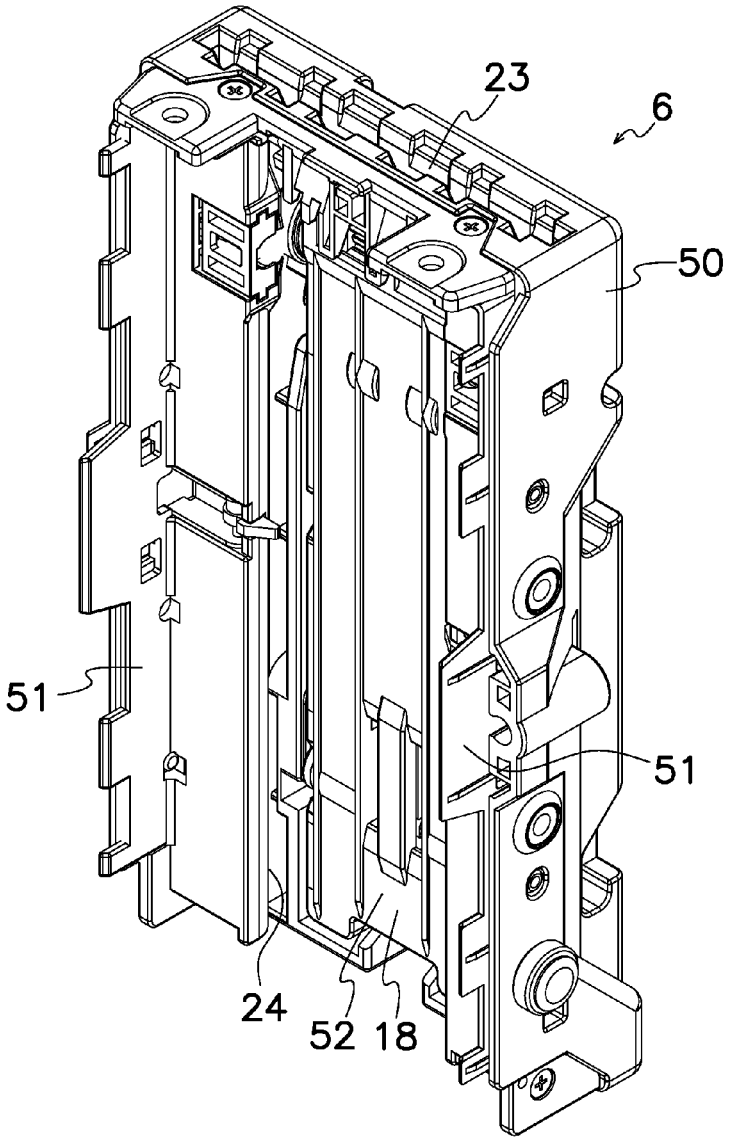
FIG. 7 is a perspective view showing inside of an inner endplate attached to an inner end of the sleeve.
Figure 8:
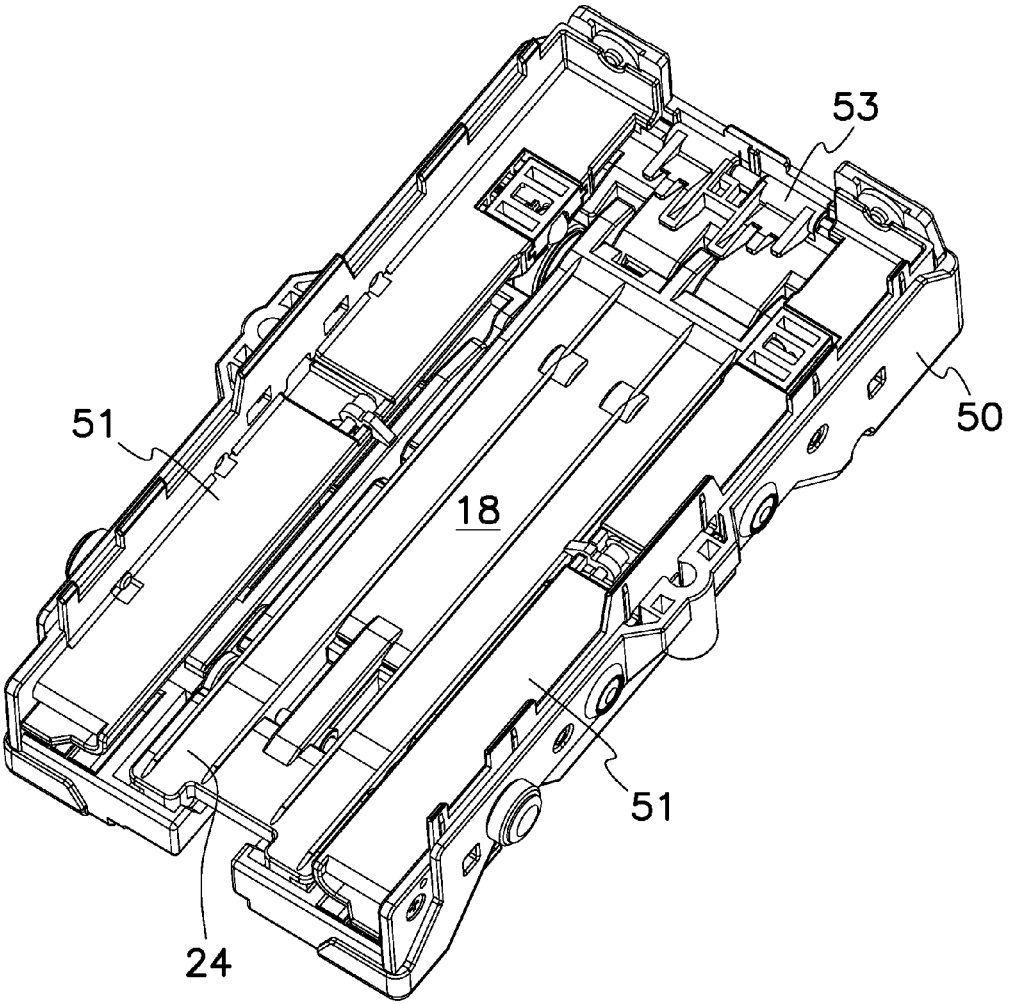
FIG. 8 is another perspective view showing inside of the inner endplate.

As seen from FIGS. 1 and 7, inner endplate 6 of stacker 2 comprises a case 50 formed with a window 21 across from validator 1, a slit 23 defined on a top wall of case 50, an interim chamber 24 for receiving a bill supplied from validator 1 through slit 23, and a pusher plate 18 movable between an initial position within interim chamber 24 and an extended position within storage 7. Inner endplate 6 also comprises a linkwork or X-linkage 20 fixed to inner surface of case 50 adjacent to window 21 of case 50. Head 16 of rocker 10 is arranged in the vicinity of and across from X-linkage 20 that is disposed behind and linked to pusher plate 18 to move pusher plate 18 between the initial position in inner endplate 6 and extended position in storage 7 when X-linkage 20 is extended and retracted by head 16 of swinging rocker 10 and coiled springs 28. X-linkage 20 is securely fixed within inner endplate 6 shown in FIG. 11 to collaborate in operation with rocker 10, pinion 12 and drive device 11 in validator 1 for movement of pusher plate 18 as mentioned below.

As shown in FIGS. 7 to 12, case 50 comprises a pair of guide plates 51 disposed inside case 50 to define an opening 52 between guide plates 51. During operation of X-linkage 20, pusher plate 18 presses a bill in interim chamber 24 to pass the bill through opening 52 and stow it into storage 7. As shown in FIG. 9, interim chamber 24 is defined between a pair of anterior guide plates 51 and posterior pusher plate 18 arranged behind guide plates 51 to receive a bill within interim chamber 24 after the bill is supplied into interim chamber 24 through slit 23. As seen from FIGS. 8 and 9, a retaining lever 53 is rotatably attached to case 50 in a spring-biased fashion (not shown) to constantly maintain retaining lever 53 usually substantially flush with a pair of guide plates 51 to keep an upper end of the bill within interim chamber 24. When X-linkage 20 moves pusher plate 18, retaining lever 53 is rotated against resilient force of the biasing spring to release and allow the bill to enter into storage 7 through opening 52.

Figure 11:
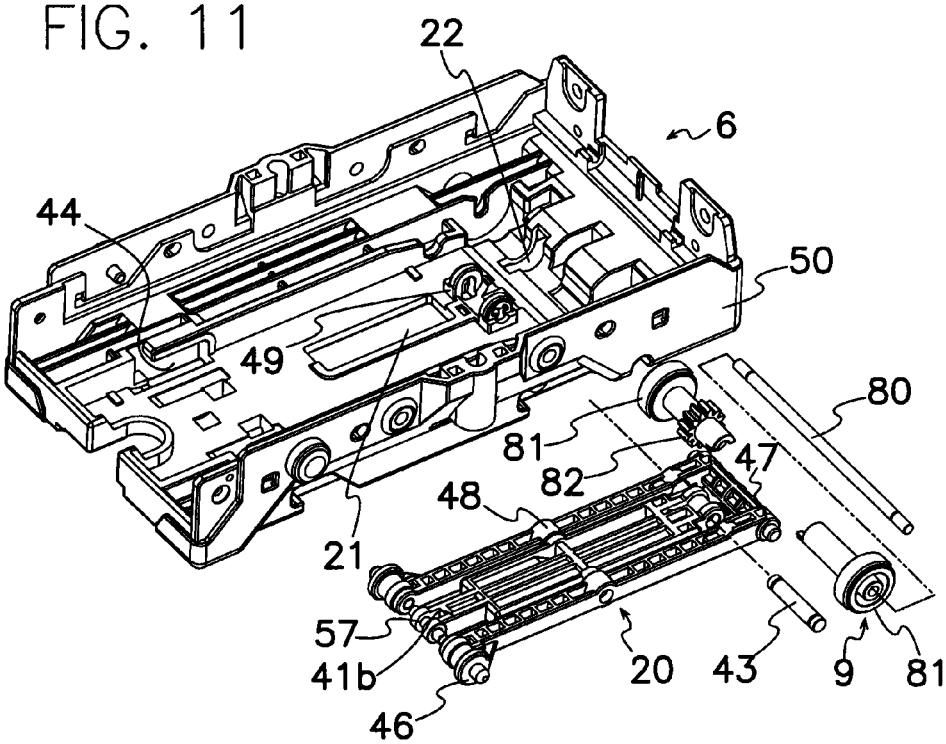
FIG. 11 is an exploded view of the inner endplate with removal of an X-linkage and a roller device in FIG. 9.
Figure 12:
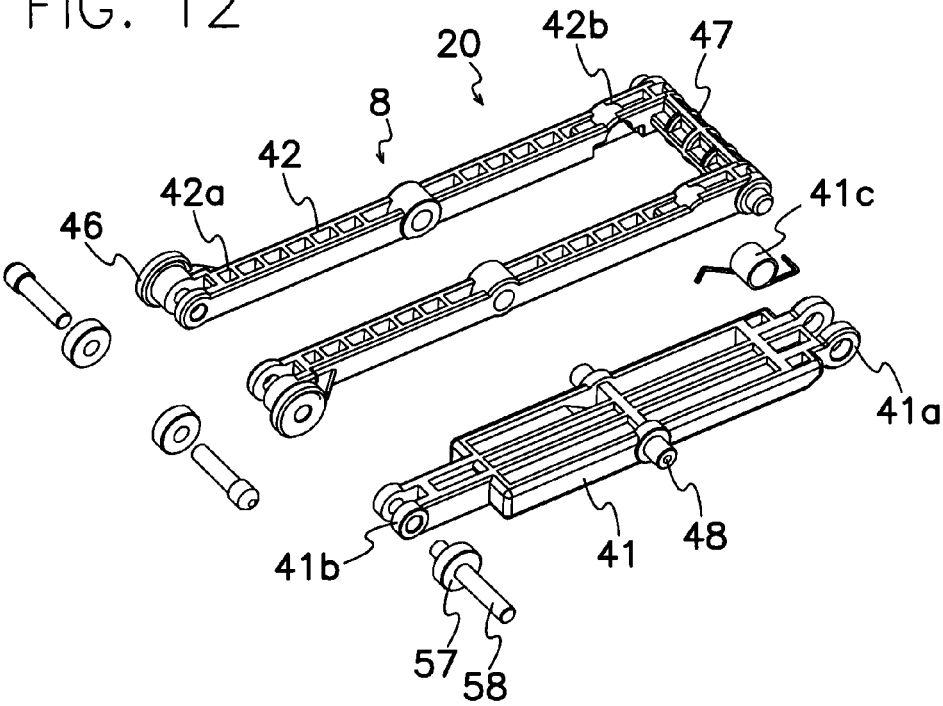
FIG. 12 is an exploded view of the X-linkage in FIG. 11.
Figure 17:
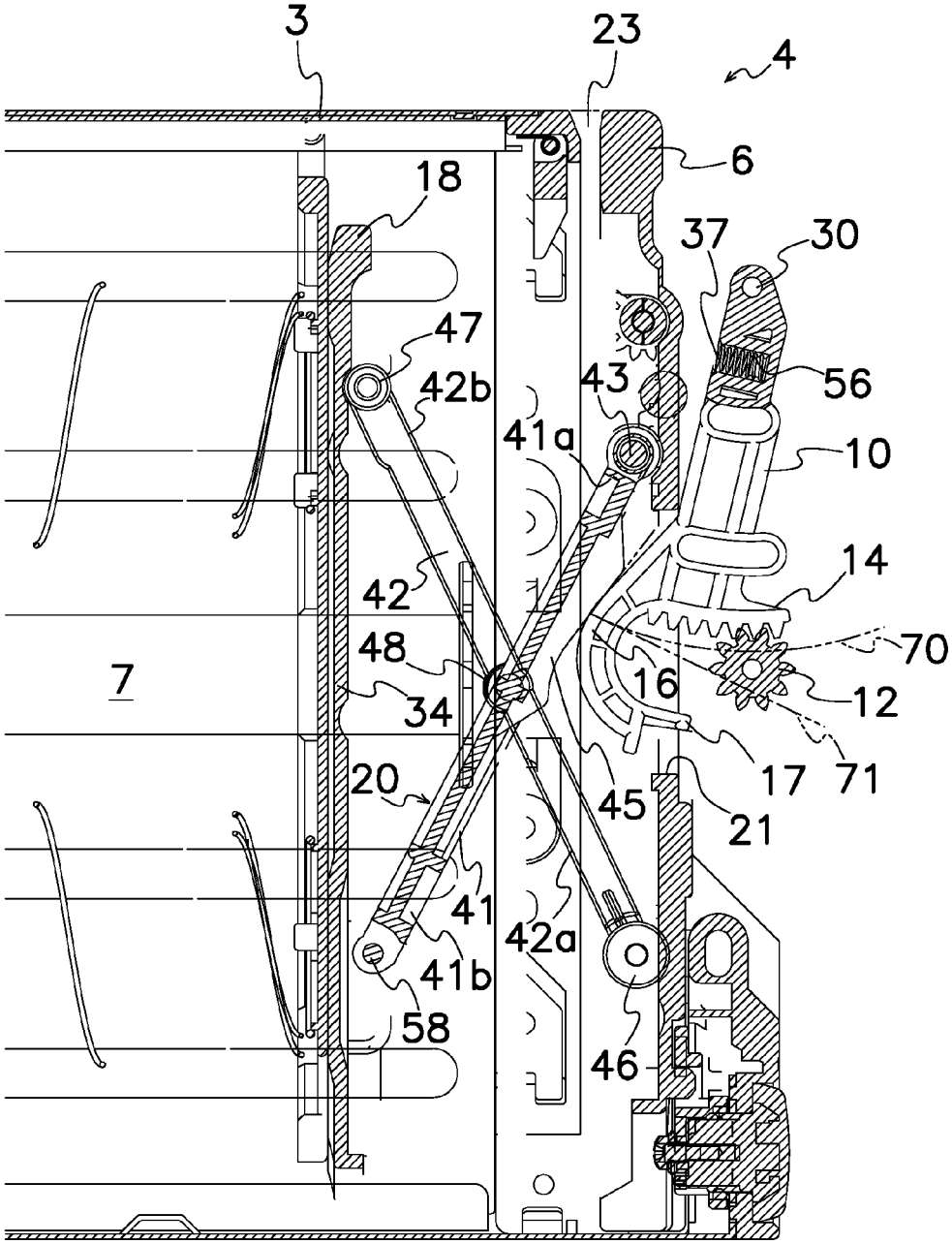
FIG. 17 is a partial sectional view of the stacker with the pusher plate moved into an extended position by rotation of the rocker for extension of the X-linkage.

As shown in FIGS. 11 and 12, X-linkage 20 has driver and follower arms 41, 42 pivoted at their central area by a juncture shaft 48 to form together into X-linkage 20 for bringing the bill into storage 7. One forked stationary end 41*a* of driver arm 41 is rotatably supported on a bearing 49 attached to inner endplate 6 by an axis 43 fixed on casing 4 of stacker 2, and the other forked movable end 41*b* of driver arm 41 is provided with a rotation axis 58 of a roller 57 in its rotatable contact to a back surface of pusher plate 18 (FIG. 17). A spring 41*c* produces a resilient force to constantly push driver arm 41 toward its initial position shown in FIG. 15.

Follower arm 42 of channel-shaped section has at least one free end or two separated ends 42*a* each provided with a roller 46 rotatably and slidably received within a related elongated chase 44 formed on each of side walls in inner endplate 6, and the other two ends 42*b* of follower arm 42 are joined each other by a connector 47 in contact to a back surface of pusher plate 18. As illustrated in FIG. 15, driver arm 41 of X-linkage 20 has a saddle-shaped curved passive area 45 formed between stationary end 41*a* and pivoted central area of driver arm 41 for the purpose of using a leverage of drive arm 41 when head 16 of rocker 10 moves and comes into contact to passive area 45 through opening 21 formed in case 50 of inner endplate 6. When drive motor 13 is activated to rotate rocker 10, head 16 simultaneously presses passive area 45 formed between stationary end 41*a* and pivoted central area of driver arm 41 to convert and enlarge a small moving distance of rocker 10 into a large moving distance of X-linkage 20 by means of the leverage for motion transform between rotation of rocker 10 and extension of X-linkage 20.

Figure 13:
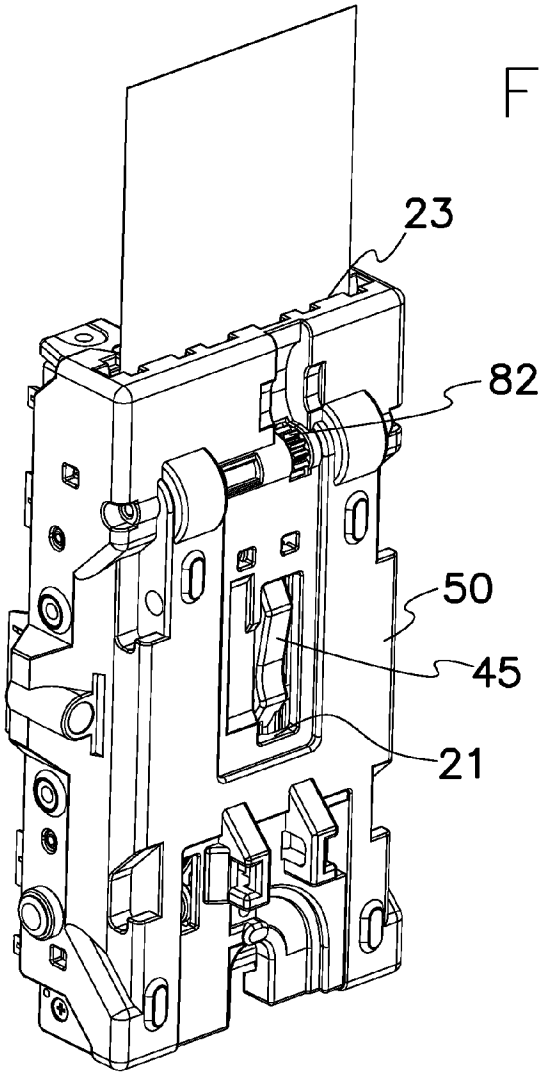
FIG. 13 is a perspective back view of the inner endplate showing a bill transported through a slit into inside of the inner endplate.
Figure 14:
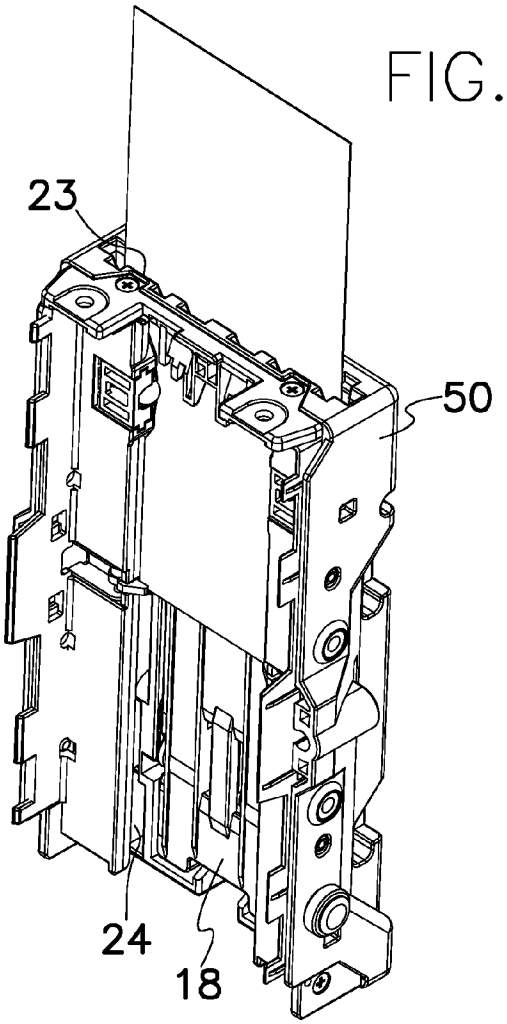
FIG. 14 is a perspective view illustrating inside of the inner endplate in FIG. 13.

As shown in FIG. 11, conveyor device 61 of validator 1 comprises a shaft 80 rotatably attached within case 50 of inner endplate 6, a pair of rollers 81 rotatably mounted on shaft 80 and a feed gear 82 secured on shaft 80. An outer half of feed gear 82 reaches out of case 50 through an opening 22 as illustrated in FIG. 13 to automatically bring outer half of feed gear 82 into driving engagement with a drive gear not shown in conveyor device 61 of validator 1 when stacker 2 is attached to validator 1. During operation, drive device 61 in validator 1 rotates feed gear 82 in case 50 to thereby rotate a pair of rollers 81 that transport a bill inserted into validator 1 and considered authentic through slit 23 into interim chamber 24 to keep the bill in interim chamber 24.

During a halt condition of drive device 11, pusher plate 18 is in the initial position shown in FIG. 15 with rocker 10 and X-linkage 20 being kept in their parallel condition with each other. With drive motor 13 of drive device 11 starting rotation, sector gear 14 rotates through deceleration device 9 and pinion 12 to swing rocker 10 toward positive area 45 of drive arm 41 through opening 21 of stacker 2 against resilient force of spring 37. Thus, as shown in FIGS. 15 and 17, head 16 moves along a circular track 70 around pivot shaft 30, comes into detachable contact to and pushes positive area 45 of drive arm 41 that rotates around axis 43 in the same rotational direction as head 16 swings to extend X-linkage 20 and move pusher plate 18 from the initial position to the extended position. A tangent line 71 to circular arc track 70 at the contact point between positive area 45 and head 16 forms a pushing angle θ (theta) relative to a contact surface of positive area 45. When head 16 pushes contact surface of positive area 45 in the exactly same rotational direction as head 16 swings, the pushing angle θ forms 90 degrees and means the pressure angle "0 (zero)" of head 16 to positive area 45.

Specifically, the embodiment shown in FIG. 15 illustrates head 16 that comes into contact with saddle-like passive area 45 of drive arm 41 during revolution of head 16 that may thrust passive area 45 at the pushing angle θ of approximately 93 degrees between passive area 45 and tangent line 71 to circular arc track 70 at the contact point between positive area 45 and head 16. The pushing angle θ=93 degrees is equal to a pressure angle of 3 degrees that is obviously far small than maximum pressure angle of 45 degrees confined for prior art cam devices. This means that head 16 can press positive area 45 of drive arm 41 with the substantial pressure angle of 3 degrees within plus and minus (±) 20 degrees in substantially the same rotational direction as head 16 swings without slippage involving friction, wear and abnormal noise between head 16 and positive area 45, and X-linkage 20 can smoothly be expanded to slickly move pusher plate 18 from the initial to the extended position and to readily stow a bill within interim chamber 24 into storage 7 by means of X-linkage 20.

In the present invention, head 16 should not necessarily push passive area 45 in exactly the same rotational direction as the circular arc movement of head 16 wherein the pushing angle θ is exactly 90 degrees with pressure angle "0 (zero)". In other words, head 16 may press passive area 45 in a pushing direction at an angle different from a moving direction of passive area 45 if the angular difference is within an angular range of plus and minus 20 degrees wherein a pushing angle θ is in an angular range between 70 and 110 degrees in FIG. 15 that would involve little or minimum slippage between head 16 and passive area 45 because all of attendant slippage, friction, wear and abnormal noise is very little. Thus, during extension of X-linkage 20, head 16 can effectively push passive area 45 at a substantially right angle or on the order of right angle between head 16 and passive area 45. Accordingly, the phrase "the same rotational direction as the circular arc movement of head 16" herein may contain the angular difference "zero" and "within plus and minus 20 degrees" between the pushing direction of head 16 and the moving direction of passive area 45.

Also, rocker 10 and X-linkage 20 may be advantageously linked to form a leverage that may enlarge a small travel stroke of rocker 10 to a large moving distance of pusher plate 18 through X-linkage 20. Specifically, head 16 presses passive area 45 located between stationary end 41*a* and pivoted central area of driver arm 41 making use of the leverage for motion transform between rotation of rocker 10 and extension of X-linkage 20 to convert or expand small moving distance of rocker 10 into large moving distance of X-linkage 20 and also to concurrently displace pusher plate 18 in its constantly parallel attitude by X-linkage 20 for smooth and positive stowage of bills into storage 11. X-linkage 20 also may expediently translate pusher plate 18 to the extended position while constantly keeping it in a parallel shift attitude for smooth and secure stowage of the document into storage 11.

Head 16 of rocker 10 swings in its circular arc motion that brings passive area 45 of X-linkage 20 into a circular movement in the same turning direction as head 16 swings to easily and smoothly stow a document in interim chamber 24 into storage 7. The present invention may suit to a document validating/stacking device that comprises a stacker provided with an X-linkage and a validator for operating the X-linkage.

In this way, the present invention can accomplish positive stowage of a bill in interim chamber 24 into storage 7 of stacker 2 by the linked smooth circular arc motion in the same rotational direction of rocker 10 and X-linkage 20. In this case, ordinary skill in the art would be able to adjust the teeth number in sector gear 14 to match selected movement rate and rotation of rocker 10. After movement of pusher plate 18 to the extended position shown in FIG. 17 by operation of drive device 11, drive motor 13 may be driven in the adverse direction to return head 16 and rocker 10 to their initial position shown in FIG. 15 through reversed drive device 11 of large reduction gear ratio in collaboration with resilient forces of coiled springs 28 and spring 37.

Figure 18:
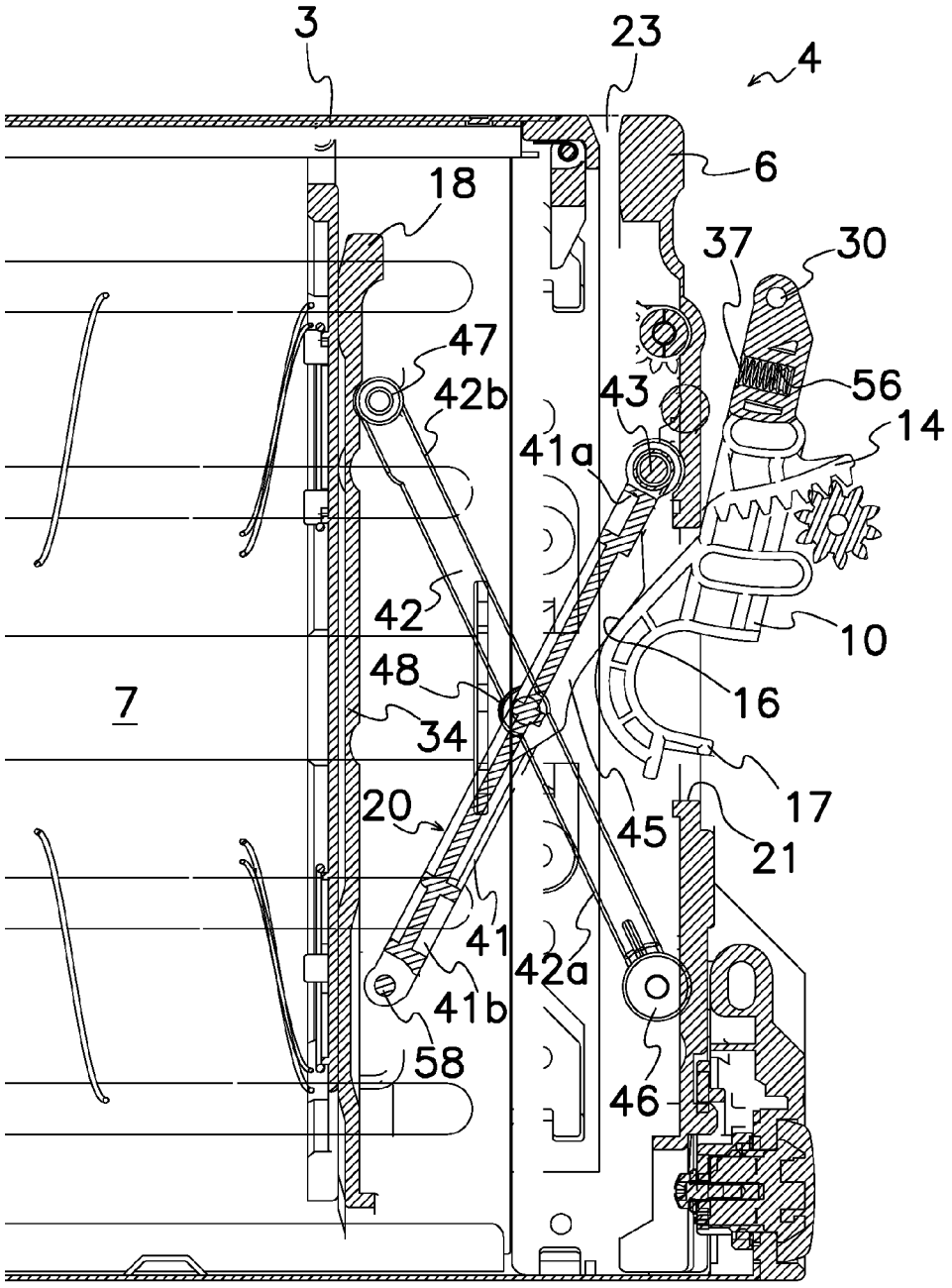
FIG. 18 is a partial sectional view of a sector gear attached to a different position of the rocker.

FIG. 18 shows a second embodiment of the present invention with sector gear 14 attached to arm 31 closer to pivot shaft 30 unlike the first embodiment in FIG. 15.

Figure 19:
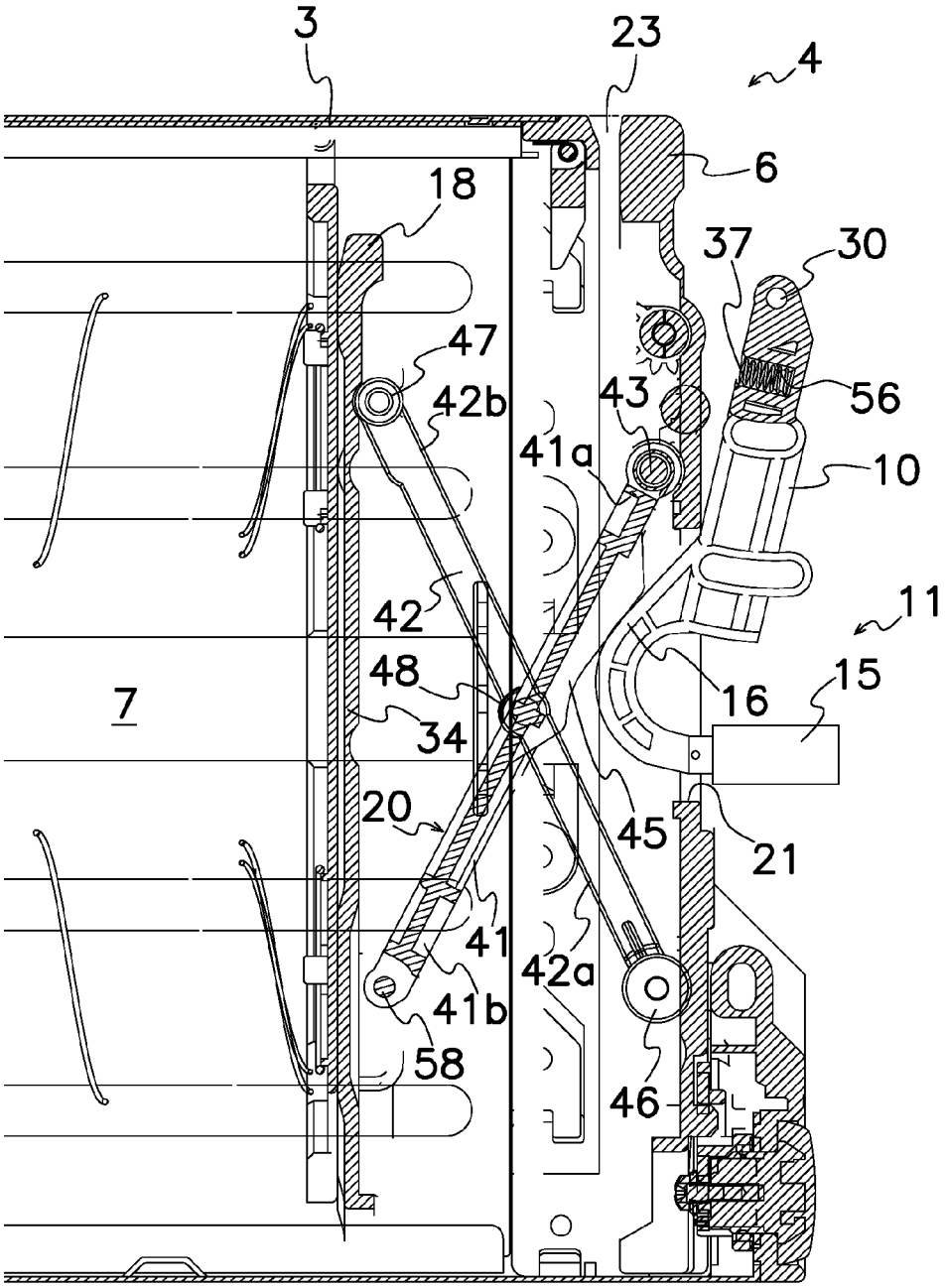
FIG. 19 is a partial sectional view of the drive device composed of an alternative solenoid.

FIG. 19 illustrates a third embodiment of the invention wherein drive device 11 comprises a solenoid 15 for rotating rocker 10 in lieu of drive device 11 made up of a drive motor and a sector gear. Push-pull operation of solenoid 15 allows rocker 10 to move to extend X-linkage 20 to stow a bill into storage 7, and to retract it to return rocker 10 to the original position in collaboration with resilient forces of coiled springs 28 and spring 37.

The invention claimed is:

1. A document validating/stacking device comprising: a validator for discriminating authenticity of an inserted document and a stacker detachably attached to the validator for storing the document supplied from validator, wherein the validator comprises a rocker rotatably attached around a pivot shaft, a head formed with the rocker and a drive device for rotating the rocker around the pivot shaft, the stacker comprises an interim chamber for receiving the document supplied from the validator, a storage for receiving and holding the document supplied from the interim chamber, a pusher plate movable between an initial position within the interim chamber and an extended position within the storage, and an X-linkage having a driver arm, the rotation of the rocker causes the head to move in a circular arc to separably push a passive area of the driver arm that therefore rotates in the same rotational direction as the circular arc movement of the head to expand the X-linkage, to thereby move the pusher plate from the initial position to the extended position and to stow the document within the interim chamber into the storage, the rocker comprises an arm rotatably supported by the pivot shaft attached to the validator, and the head and a sector gear are formed with the arm.

2. The document validating/stacking device of claim 1, wherein the head may push the passive area of the drive arm in the pushing direction different from the moving direction of the passive area within an angular range of plus and minus 20 degrees.

3. The document validating/stacking device of claim 1, wherein the stacker has a casing formed with an opening, the rotation of the rocker causes the head to come into contact to and press the passive area of the X-linkage through the opening formed in a casing of the stacker for extension of the X-linkage.

4. The document validating/stacking device of claim 3, wherein the pivot shaft for rotatably supporting the rocker is arranged in the validator above the opening formed in the casing of the stacker.

5. The document validating/stacking device of claim 3, wherein the driver arm of the X-linkage has a stationary end rotatably connected to an axis of the casing.

6. The document validating/stacking device of claim 1, wherein the rocker and X-linkage are linked to form a leverage that enlarges a small travel stroke of the rocker to a large moving distance of the pusher plate through the X-linkage.

7. The document validating/stacking device of claim 6, wherein the X-linkage translates the pusher plate between the initial position and the extended position, while constantly keeping the pusher plate in its parallel movement attitude.

8. The document validating/stacking device of claim 1, wherein the drive device comprises a drive motor and a pinion rotated by the drive motor, and the rocker comprises a sector gear meshed with the pinion of the drive device.

9. The document validating/stacking device of claim 1, wherein the rocker comprises an arcuate extension protruded from the arm, the arcuate extension is formed with the head that may come into contact to the passive area in the X-linkage during rotation of the rocker.

10. The document validating/stacking device of claim 1, wherein the X-linkage is irremovably disposed within an inner endplate of the stacker, the X-linkage comprises a follower arm rotatably connected to the driver arm by a juncture shaft to form into an X-shape together, one end of the driver arm is rotatably supported on a bearing attached to the inner endplate, the other end of the driver arm is in slidable contact to a back surface of the pusher plate, the follower arm has at least one free end with a rotatable roller attached thereto, the inner endplate is formed with at least one elongated chase to slidably receive the rotatable roller within the elongate chase.

11. A document validating/stacking device comprising: a validator for discriminating authenticity of an inserted document and a stacker detachably attached to the validator for storing the document supplied from validator, wherein the validator comprises a rocker rotatably attached around a pivot shaft, a head formed with the rocker, a drive device for rotating the rocker around the pivot shaft and a spring disposed between the rocker and a frame of the validator, the stacker comprises an interim chamber for receiving the document supplied from the validator, a storage for receiving and holding the document supplied from the interim chamber, a pusher plate movable between an initial position within the interim chamber and an extended position within the storage, and an X-linkage having a driver arm, the rotation of the rocker causes the head to move in a circular arc to separably push a passive area of the driver arm that therefore rotates in the same rotational direction as the circular arc movement of the head to expand the X-linkage, to thereby move the pusher plate from the initial position to the extended position and to stow the document within the interim chamber into the storage, the drive device rotates the rocker against resilient force of the spring to move the pusher plate to the extended position, and then, the rocker is returned to the original position by the adverse rotation of the drive device and the resilient force of the spring.

12. A document validating/stacking device comprising: a validator for discriminating authenticity of an inserted document and a stacker detachably attached to the validator for storing the document supplied from validator, wherein the validator comprises a rocker rotatably attached around a pivot shaft, a head formed with the rocker and a drive device for rotating the rocker around the pivot shaft, the stacker comprises an interim chamber for receiving the document supplied from the validator, a storage for receiving and holding the document supplied from the interim chamber, a pusher plate movable between an initial position within the interim chamber and an extended position within the storage, and an X-linkage having a driver arm, the rotation of the rocker causes the head to move in a circular arc to separably push a passive area of the driver arm that therefore rotates in the same rotational direction as the circular arc movement of the head to expand the X-linkage, to thereby move the pusher plate from the initial position to the extended position and to stow the document within the interim chamber into the storage, and the rocker comprises an arm formed with at least one arcuate hole that receives a support shaft attached to the validator.

13. A document validating/stacking device comprising: a validator for discriminating authenticity of an inserted document and a stacker detachably attached to the validator for storing the document supplied from validator, wherein the validator comprises a rocker rotatably attached around a pivot shaft, a head formed with the rocker and a drive device for rotating the rocker around the pivot shaft, the stacker comprises an interim chamber for receiving the document supplied from the validator, a storage for receiving and holding the document supplied from the interim chamber, a pusher plate movable between an initial position within the interim chamber and an extended position within the storage, and an X-linkage having a driver arm, the rotation of the rocker causes the head to move in a circular arc to separably push a passive area of the driver arm that therefore rotates in the same rotational direction as the circular arc movement of the head to expand the X-linkage, to thereby move the pusher plate from the initial position to the extended position and to stow the document within the interim chamber into the storage, and the drive device comprises a deceleration device made up of gears mounted on the pivot shaft and support shaft attached to the validator.

* * * * *